US007530426B2

(12) United States Patent
Berkhoff

(10) Patent No.: US 7,530,426 B2
(45) Date of Patent: May 12, 2009

(54) DEVICE FOR ACTIVELY REDUCING SOUND TRANSMISSION, AND PANEL COMPRISING SUCH DEVICE

(75) Inventor: Arthur Perry Berkhoff, Doetinchem (NL)

(73) Assignee: Nederlandse Organisatie voor toegepast-natuurwetenschappelijk Onderzoek TNO, Delft (NL)

( * ) Notice: Subject to any disclaimer, the term of this patent is extended or adjusted under 35 U.S.C. 154(b) by 494 days.

(21) Appl. No.: 10/545,138

(22) PCT Filed: Feb. 11, 2004

(86) PCT No.: PCT/NL2004/000102

§ 371 (c)(1),
(2), (4) Date: Aug. 10, 2005

(87) PCT Pub. No.: WO2004/072945

PCT Pub. Date: Aug. 26, 2004

(65) Prior Publication Data

US 2006/0162264 A1 Jul. 27, 2006

(30) Foreign Application Priority Data

Feb. 11, 2003 (NL) ..... 1022647

(51) Int. Cl.
*F01N 1/06* (2006.01)
*F01N 1/20* (2006.01)
*F01N 1/02* (2006.01)
*G10K 11/16* (2006.01)

(52) U.S. Cl. ..... 181/206; 381/71.2

(58) Field of Classification Search ..... 181/287, 181/206; 381/71.2, 191; 702/103; 244/1 N, 244/53 B; 415/119
See application file for complete search history.

(56) References Cited

U.S. PATENT DOCUMENTS

| | | | | |
|---|---|---|---|---|
| 5,382,134 | A * | 1/1995 | Pla et al. | 415/119 |
| 5,415,522 | A * | 5/1995 | Pla et al. | 415/118 |
| 5,423,658 | A * | 6/1995 | Pla et al. | 415/118 |
| 5,558,298 | A * | 9/1996 | Pla et al. | 244/1 N |
| 5,618,010 | A * | 4/1997 | Pla et al. | 244/1 N |
| 5,702,230 | A | 12/1997 | Kraft et al. | |
| 5,919,029 | A | 7/1999 | Van Nostrand et al. | |
| 5,979,593 | A * | 11/1999 | Rice et al. | 181/207 |
| 6,178,246 | B1 * | 1/2001 | Bebesel et al. | 381/71.2 |

FOREIGN PATENT DOCUMENTS

| | | |
|---|---|---|
| EP | 0 824 255 A2 | 2/1998 |
| EP | 0999 540 A1 | 5/2000 |
| WO | WO 94/05005 | 3/1994 |
| WO | WO 02/11117 A2 | 2/2002 |

* cited by examiner

*Primary Examiner*—Edgardo San Martin
(74) *Attorney, Agent, or Firm*—Hoffmann & Baron, LLP

(57) ABSTRACT

A device for actively reducing sound transmission, provided with a first and second wall (3, 5) enclosing an inner space (1, 2), wherein at least the second wall (5) is provided with actuators (6), for instance eletromagnetic actuators and/or piezoeleteric elements, wherein the said inner space is provided with at least one inner wall (4) to divide this space into at least two layers of air (1, 2), which inner wall (4) is arranged such that the layers of air (1, 2) are in fluid connection with each other.

20 Claims, 1 Drawing Sheet

DEVICE FOR ACTIVELY REDUCING SOUND TRANSMISSION, AND PANEL COMPRISING SUCH DEVICE

This application is the U.S. National Phase of International Application Number PCT/NL2004/000102 filed on 11 Feb. 2004, which is incorporated herein by reference.

BACKGROUND OF THE INVENTION

The invention relates to a device for actively reducing sound transmission, provided with a first and a second wall enclosing an inner space, wherein at least the second wall is provided with actuators, for instance electromagnetic actuators and/or piezoelectric elements.

Such a device is known from practice, in particular in the form of a sound transmission-reducing panel, and is, for instance, described in international patent application WO94/05005. The device may, for instance, be used to reduce disturbing sounds from sound-producing parts of machines, buildings, vehicles, vessels, aircraft and the like. The known device may, for instance, be placed between two spaces in order to actively reduce sound coming from one space such that as little of that sound as possible can reach an adjacent space. For this purpose, the actuators of the device can produce so-called anti-sound.

It is noted that, for the device according to the opening paragraph, sound reduction in a space in which, for instance, a strong sound source is present is not of primary importance. Thus, the device according to the opening paragraph is to be distinguished from sound-absorbing devices known from practice which are set up along a space in order to absorb a sound pressure prevailing in that same space.

The device known from practice is provided with actuators, for instance electromagnetic actuators, piezoelectric elements and the like, to actively reduce sound transmission. During use, such actuators are usually connected to an electronic control, for instance a computer or the like, to make these actuators carry out those movements by means of which sound transmission reduction is effected. The reduction of sound transmission by means of actuators is known to a skilled person and is, for instance, described in the international application WO 94/05005 referred to hereinabove, which document is considered inserted in the present application by reference. Because at least the second wall is provided with actuators, in particular, a good reduction of the transmission of low-frequency sound can be achieved.

A disadvantage of the known device is that, for a desired good sound transmission reduction, it needs to be provided with relatively heavy, complex and expensive electronics and actuators. In addition, the known device consumes relatively much energy in order to achieve a desired sound reduction. Thus, use of the known device in cases in which relatively little energy is available, for instance when the energy is obtained from a battery and/or natural energy sources such as solar and/or wind energy, is not possible or not profitable. In addition, because of the high energy consumption, the known device is relatively expensive in use.

SUMMARY OF THE INVENTION

The present invention contemplates a device for actively reducing sound, which device can have a relatively inexpensive and lightweight design and can still effect a desired great sound transmission reduction.

For this purpose, the device according to the invention is characterized by the measures of claim 1.

It has surprisingly been found that, by means of a device whose inner space is provided with at least one inner wall to divide this space into at least two layers of air, which inner wall is arranged such that the layers of air are in fluid connection with each other, a relatively great sound transmission reduction can be effected by means of relatively light, simple and inexpensive electronics and actuators. In addition, the energy consumption of the device according to the invention, at least with a control of the actuators which has been correctly set and/or calibrated for this purpose, has been found to be relatively low. The setting and/or calibration of the actuator control desired for sound transmission reduction can be carried out by a skilled person by means of simple standard measurements and/or an automated feedback system. Here, the device may, for instance, be set up between two test spaces, with sound being produced in one space, while it is detected in the other space to what extent the device has reduced the transmission of this sound with a certain setting of the actuator control. It has been found that, as a result of the relatively simple construction of the device according to the invention, the actuator control can be designed relatively simply, for instance because the control contains a relatively simple mathematical algorithm to control the actuators of the device via control electronics.

The device provided by the invention can, in itself, have a relatively simple, lightweight and inexpensive design, which is advantageous and desired for various uses. In addition, the device according to the invention can be used with advantage in situations in which relatively little energy is available. In addition, use of the device according to the invention is relatively inexpensive and environment-friendly, due to its low energy consumption. Further, the device according to the invention can have a relatively compact, durable and robust design, so that the device is easily employable in various uses.

The invention has been found to particularly effect a good reduction of the sound when the first wall is connected to the inner wall by substantially stiff connecting means, while the second wall is connected to the inner wall by flexible connecting means. In this manner, the device comprises a relatively stiff part in which the first layer of air is provided, while the actuators and the second wall can carry out the desired movements for reduction of the sound.

BRIEF DESCRIPTION OF THE DRAWING

Further elaborations of the invention are described in the subclaims. The invention will now be elucidated on the basis of an exemplary embodiment and with reference to the drawing, in which:

FIGS. 1 and 2 show an embodiment of a device P for actively reducing sound transmission. The device may, for instance, be used to reduce transmission of sound coming from a source space A, which is indicated by arrows S in FIG. 2, to an adjoining target space B.

DETAILED DESCRIPTION OF THE INVENTION

The device comprises a panel P, provided with a first and a second solid, relatively stiff wall 3, 5 enclosing an inner space. Because the first and second wall 3, 5 have a solid design, this inner space is, at least on longitudinal sides, fluid-tightly closed off from the environment A, B. The inner space is divided into two layers of air 1, 2 by a relatively stiff inner wall 4 set up between the first and second wall 3, 5. In the exemplary embodiment, this inner wall 4, first wall 3, second wall 5 and the layers of air 1, 2 are substantially parallel. The second wall 5 preferably has a lightweight design, for instance in that this wall 5 comprises a relatively thin plate or the like.

Figure 1:
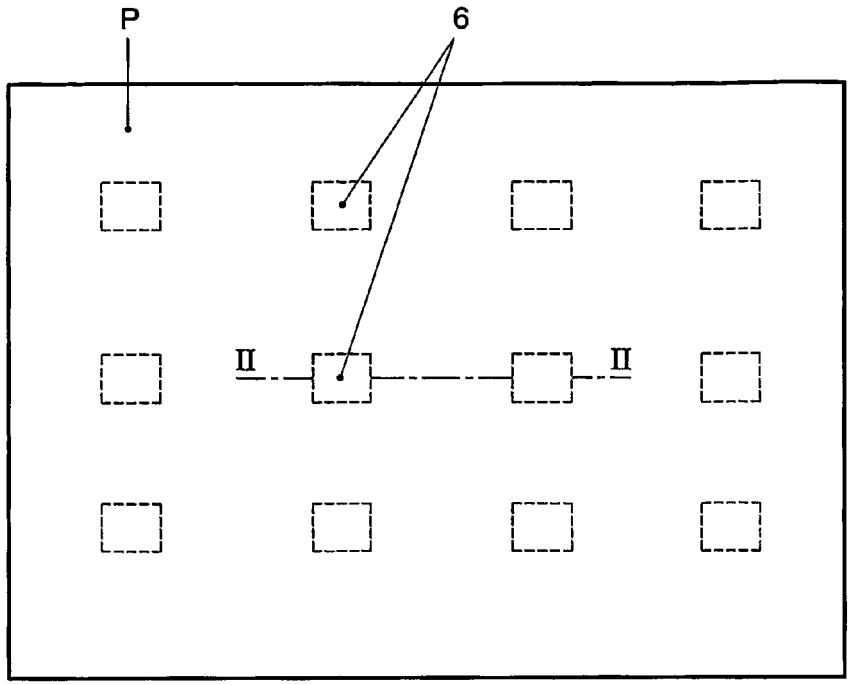
FIG. 1 shows a front view of an exemplary embodiment of the invention.
Figure 2:
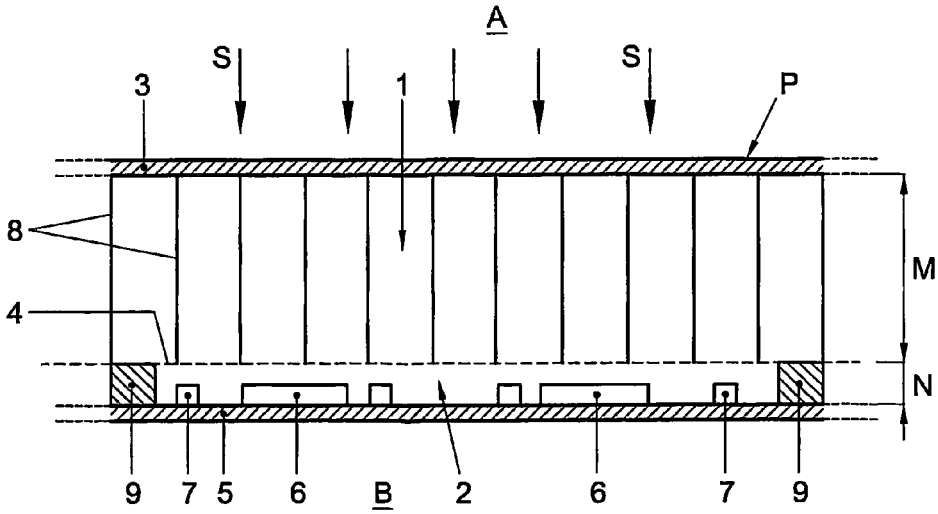
FIG. 2 shows a cross section over line II-II of the front view shown in FIG. 1.

The first wall 3 and the inner wall 4, which enclose the first layer of air 1, are relatively stiffly connected to each other. For this purpose, these walls 3, 4 may, for instance, be coupled to each other via a sandwich structure or a similar relatively open structure. FIG. 2 diagrammatically shows such a structure in the form of stiffening walls 8 extending between the first wall 3 and inner wall 4, perpendicularly through the first layer of air 1. These stiffening walls 8 divide the first layer of air 1 into substantially separated air chambers. Preferably, this stiffening structure contains honeycomb cores, which results in a good stiff connection between these walls 3, 4, while the structure still has a relatively open design. The inner wall 4 has a perforated design, so that the second layer of air 2 is in fluid connection with the first layer of air 1, at least with the air chambers thereof. The second wall 5 is connected to the inner wall 4 via flexible means 9, for instance spring means and/or elastic material. Thus, the second wall 5 has a certain freedom of movement with respect to the inner wall 4.

For the purpose of sound transmission reduction, the second wall 5, preferably which faces the target space B during use, is provided with a number of actuators 6 and sensors 7. In the exemplary embodiment, the actuators and sensors are provided on the inside of the second wall 5, so that these means are neatly concealed in the panel P. The actuators 6 are particularly arranged to make this second wall 5 carry out the desired vibrations to be able to reduce, for instance, radiated sound. Preferably, the second wall 5 has a less stiff design than the first wall 3, so that, during use, the actuators need relatively little energy to effect a desired sound reduction via this second wall 5.

The first layer of air 1 is thicker than the second layer of air 2. As a result, the second layer of air 2 has a relatively small volume compared to the first layer of air 1. The thickness of the at least first layer of air is, for instance, larger than approximately 1 mm, while the thickness of the at least second layer of air is, for instance, in the range of, for instance approximately 0.5-50 mm. The thickness of the second layer of air is further preferably such that the second wall 5 and the actuators 6 provided on it can carry out the movements desired for the sound reduction without being hindered by the opposite inner wall 4.

As a result of the design described, the panel P has been found to be surprisingly efficient, so that it can effect a relatively great sound reduction by means of relatively simple and inexpensive electronics and actuators 6 and with a relatively low energy consumption of the actuators 6. Further, relatively simple mathematical algorithms can be used compared to acoustic panels known from the state of the art to obtain a desired reduction level of the sound. Without wishing to be bound to any theory, a possible explanation is that the device has a relatively stiff design and has a relatively large internal air volume, so that the actuator energy needed to reduce radiated sound is strongly reduced.

It goes without saying that the invention is not limited to the exemplary embodiment described. Various modifications are possible within the scope of the invention as set forth in the following claims.

For instance, the solid walls may be designed in various manners and in various dimensions.

Further, at least one of the layers of air can be divided into chambers in various manners, in particular by providing a certain structure in this layer of air, for instance a sandwich structure, a honeycomb structure, transverse walls and/or other means. Such a structure may also serve to relatively stiffly connect at least the first wall 3 and the inner wall 4 to each other. Such a stiff connection can also be effected by using other connecting means, for instance nut/bolt connections, rigid connecting elements and a combination of the said or other connecting means.

Further, the device may, for instance, be provided with sound-absorbing material containing at least one or a part of the layers of air 1, 2. In that case, a surface of this material may, for instance, serve as the inner wall 4 which separates the two layers of air 1, 2.

Further, the layers of air 1, 2 may extend in different directions relative to each other and, for instance, be substantially parallel to each other or include certain angles.

In addition, the inner wall 4 and the first and second wall 3, 5 may each be manufactured from various materials, for instance from a metal, alloy, glass, plastic, an optionally fiber-reinforced material, wood or a combination of these or other materials.

In addition, the first wall 3 of the device may also be provided with actuators in order to reduce the sound transmission of sound coming from an opposite direction. In that case, the first wall 3 may, for instance, directly adjoin the second layer of air 2, or, conversely, be separated from the second layer of air 2 by a third layer of air, while a second inner wall is provided between this third layer of air and the second layer of air.

Further, the actuators 6 may, for instance, be coupled to the second wall 5 in a fixed manner or via flexible connections. In addition, the actuators may effect sound transmission reduction via movement of this second wall 5 or, conversely, substantially independent of movements of this second wall 5.

Further, each at least first layer of air may have a thickness which is larger than, equal to or smaller than the thickness of the at least second layer of air.

In addition, the device may be designed in different manners and be provided with a control to reduce transmission of sound of relatively low and/or relatively high frequencies.

Further, the sensors can be provided in various positions in the panel P, for instance on the first wall, inner wall, second wall or in another position.

The device P is also usable in combination with sensors disposed at a distance from the second wall 5 in the target space B.

The sensors may, for instance, comprise vibration, strain, acceleration and/or sound sensors. These sound sensors may, for instance, be mounted outside the panel P in the target space B, for instance in that these sensors are disposed on an outside of the second wall facing away from the inner space.

The invention claimed is:

1. A device for actively reducing sound transmission, provided with a first and a second wall (3, 5) enclosing an inner space (1, 2), wherein at least the second wall (5) is provided with actuators (6), wherein the actuators (6) are at least one of electromagnetic and piezoelectric elements, wherein the inner space is provided with at least one inner wall (4) to divide this space into at least two layers of air (1, 2), wherein the inner wall (4) includes a plurality of apertures passing therethrough, thereby providing direct fluid communication between the at least two layers of air (1, 2).

2. A device according to claim 1, wherein the at least first layer of air (1) has a thickness (M) which is larger than the thickness (N) of the at least second layer of air (2).

3. A device according to claim 1, wherein the second wall (5) extends along the second layer of air (2).

4. A device according to claim 1, wherein the actuators (6) are provided on an inside of the second wall (5).

5. A device according to claim 1, wherein the first wall (3) is connected to the inner wall (4) by substantially stiff connecting means (8).

6. A device according to claim 5, wherein the said substantially stiff connecting means are provided with stiffening walls (8) extending between this first wall (3) and inner wall (4).

7. A device according to claim 5, wherein the said connecting means comprise a sandwich structure.

8. A device according to claim 1, wherein the second wall (5) is connected to the inner wall (4) by flexible connecting means (9), wherein the flexible connecting means (9) includes at least one of a spring means and elastic material.

9. A device according to claim 1, wherein the second wall (5) is set up at such a distance from the inner wall (4) that this second wall (5) and the actuators (6) can carry out the movements desired for the sound reduction substantially without being hindered by the opposite inner wall (4).

10. A device according to claim 1, wherein the thickness (M) of the at least first layer of air is larger than approximately 1 mm.

11. A device according to claim 1, wherein the thickness (N) of the at least second layer of air is in the range of approximately 0.5-50 mm.

12. A device according to claim 1, wherein the inner wall (4) comprises a perforated wall.

13. A device according to claim 1, wherein at least one of the first and second wall (3, 5) has a substantially solid design.

14. A device according to claim 1, wherein the first wall (3), second wall (5) and the inner wall (4) are substantially parallel.

15. A device according to claim 1, wherein the device is provided with sensors (7), wherein the sensors (7) are at least one of vibration, strain, acceleration and sound sensors.

16. A device according to claim 15, wherein the said actuators (6) and sensors (7) are disposed at least in or near the same layer of air (2).

17. A device according to claim 15, wherein the device is provided with sound sensors disposed on a side of the second wall (5) facing away from the said inner space (1, 2).

18. A device according to claim 1, wherein at least the second wall comprises a lightweight plate.

19. A panel, comprising a device for actively reducing sound transmission, provided with a first wall and a second wall enclosing an inner space, wherein at least the second wall is provided with actuators, the actuators having at least one of electromagnetic and piezoelectric elements, wherein the inner space is provided with at least one inner wall dividing the inner space into at least two layers of air, wherein the inner wall includes a plurality of apertures passing therethrough, the apertures providing direct fluid communication between the at least two layers of air.

20. A device according to claim 1, wherein the first wall and the second wall are solid walls, configured to fluid-tightly close off the inner space, at least on longitudinal sides, from an environment.

* * * * *